US006812432B1

(12) United States Patent
Haluschka et al.

(10) Patent No.: US 6,812,432 B1
(45) Date of Patent: Nov. 2, 2004

(54) SHEATHED-ELEMENT HEATER PLUG

(75) Inventors: Christoph Haluschka, Klingenberg (DE); Juergen Arnold, Benningen (DE); Vera Wein, Stuttgart (DE); Rainer Bach, Wiernsheim (DE); Klaus Hrastnik, Stuttgart (DE); Christoph Kern, Aspach (DE)

(73) Assignee: Robert Bosch GmbH, Stuttgart (DE)

( * ) Notice: Subject to any disclaimer, the term of this patent is extended or adjusted under 35 U.S.C. 154(b) by 210 days.

(21) Appl. No.: 10/149,483

(22) PCT Filed: Nov. 8, 2000

(86) PCT No.: PCT/DE00/03898

§ 371 (c)(1),
(2), (4) Date: Sep. 27, 2002

(87) PCT Pub. No.: WO01/42715

PCT Pub. Date: Jun. 14, 2001

(30) Foreign Application Priority Data

Dec. 11, 1999 (DE) ..... 199 59 766

(51) Int. Cl.[7] ..... F23Q 7/22
(52) U.S. Cl. ..... 219/270; 123/145 A
(58) Field of Search ..... 219/270, 544; 123/145 A, 145 R; 361/264–266

(56) References Cited

U.S. PATENT DOCUMENTS

| | | | | | |
|---|---|---|---|---|---|
| 3,890,485 | A | * | 6/1975 | Kozbelt | 219/523 |
| 4,437,440 | A | * | 3/1984 | Suzuki et al. | 123/145 A |
| 6,040,519 | A | * | 3/2000 | Kita et al. | 136/230 |
| 6,414,273 | B1 | * | 7/2002 | Taniguchi et al. | 219/270 |
| 6,486,442 | B2 | * | 11/2002 | Wheeler | 219/243 |

FOREIGN PATENT DOCUMENTS

| | | |
|---|---|---|
| DE | 91 12 242 | 11/1991 |
| DE | 91 12 300 | 11/1991 |

OTHER PUBLICATIONS

Patent Abstracts of Japan, vol. 008, No. 177, Aug. 15, 1984 (JP 59 068569, Apr. 18, 1994, abstract).

* cited by examiner

*Primary Examiner*—Robin O. Evans
*Assistant Examiner*—Vinod Patel
(74) *Attorney, Agent, or Firm*—Kenyon & Kenyon

(57) ABSTRACT

A sheathed-type glow plug is provided, for example, for starting a self-igniting combustion engine, including a heating pin engaging in a combustion chamber having an ignitable fuel-air mixture, which includes an electrically conductive ceramic, and which may be heated to an ignition temperature by being connected to a voltage source, the sheathed-type glow plug surrounding an integrated temperature sensor.

9 Claims, 2 Drawing Sheets

SHEATHED-ELEMENT HEATER PLUG

FIELD OF THE INVENTION

The present invention relates to a sheathed-element glow plug, for example, for starting a self-igniting combustion engine.

BACKGROUND INFORMATION

It is believed that sheathed-element glow plugs are known. To start a self-igniting combustion engine, an initial ignition of a fuel-air mixture may be required, which may be supplied by sheathed-element glow plugs positioned in a wall of a combustion chamber. The sheathed-element glow plugs include a heating pin, which may contact the fuel-air mixture to be ignited.

The heating pin may be produced from electrically conductive ceramic. In this context, the heating pin may have a defined electrical resistance, so that a heating current will flow when the heating pin is connected to a voltage source, which may produce a specific temperature in heating the heating pin, and which may be sufficient to ignite the fuel-air mixture.

For monitoring and controlling the operation of the self-igniting combustion engine, it may be advantageous to determine the heating pin temperature. For this purpose, the temperature of the heating pin may be derived from a measurement of the heating current flowing through the heating pin. The electrically conductive ceramics, of which the heating pins may be made, may have a positive temperature coefficient. Thus, since increasing temperature causes the resistance to increase, the heating current decreases, given a constant supply voltage. From this, the instantaneous temperature of the heating pin may be determined from the time characteristic of the heating current. However, it is believed to be disadvantageous that the temperature distribution over the length of the heating pin may vary considerably at equal heating current. For example, the temperature distribution may be a function of a rotatory speed, a load condition and/or cooling of the combustion engine. Temperature differences of up to, for example, 200° C., may occur.

SUMMARY OF THE INVENTION

An exemplary sheathed-element glow plug according to the present invention permits a direct temperature measurement at the tip of a heating pin, without impairing the actual glowing function of the sheathed-element glow plug. Since the sheathed-element glow plug includes an integrated temperature sensor, the temperature of the heating pin may be determined both during active operation of the sheathed-element glow plug and during the passive set-up of the sheathed-element glow plug. This may permit an accurate measurement of the temperature, independently of the operating state of the self-igniting combustion engine.

In another exemplary embodiment according to the present invention, the temperature sensor is integrated directly into the heating pin. The heating pin may include, for example, a bore hole extending essentially axially, for accommodating the temperature sensor. The integration of the temperature sensor into the sheathed-element glow plug may be simple, and no additional construction space for the temperature sensor may be required, since the sensor is integrated inside the heating pin.

In yet another exemplary embodiment according to the present invention, the bore hole, which accommodates the temperature sensor, is positioned inside an insulating core of the heating pin, thereby permitting the temperature sensor to be positioned, without impairment of the actual glowing function of the heating pin.

In still another exemplary embodiment according to the present invention, the bore hole of the heating pin, which accommodates the temperature sensor, includes a groove with an open edge. This may permit the temperature sensor to be positioned directly adjacent to an outer circumferential wall of the heating pin, so that the temperature may be exactly measured, since the arrangement in the open edged recess obviates the need to consider the thermal transition resistance of the ceramic material of the heating pin.

DETAILED DESCRIPTION

Figure 1:
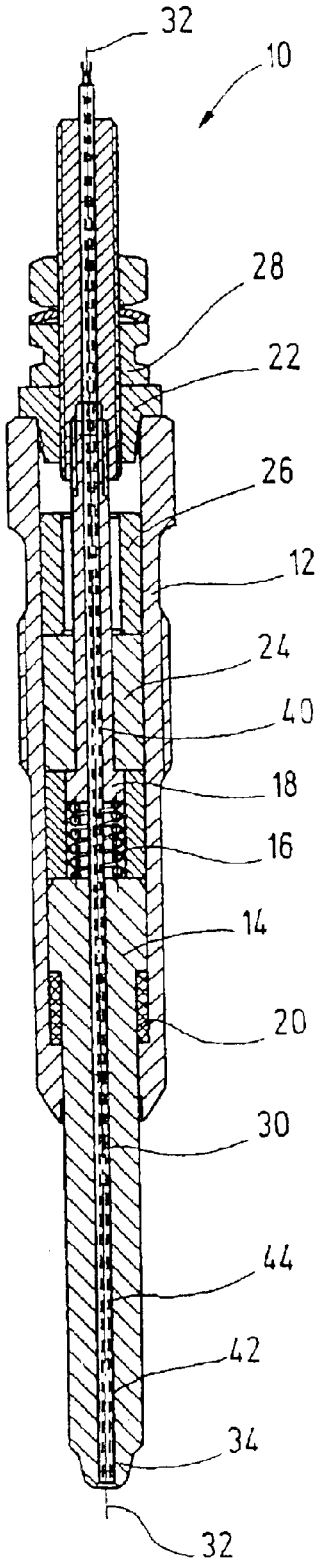
FIG. 1 is a sectional view through a first exemplary sheathed-element glow plug according to the present invention.

FIG. 1 is a sectional view through a first exemplary sheathed-element glow plug 10, which may be used to start a self-igniting combustion engine. Sheathed-element glow plug 10 includes a plug housing 12, which is essentially formed in the shape of a hollow cylinder and accommodates a heating pin 14. Plug housing 12 may be sealingly mounted in a wall of a cylinder housing (not shown), so that heating pin 14 may extend into the combustion chamber. Heating pin 14 is electrically and conductively connected to a contact stud 18 via a contact spring 16. Contact stud 18 may be connected to a voltage source, e.g., an automotive battery in a motor vehicle, so that a voltage may be applied to heating pin 14 via contact stud 18 and a contact element, such as contact spring 16. Contact pin 14 may be made of, for example, a ceramic, electrically conductive material. Sheathed-element glow plug 10 includes further components, of which seals 20 and 22, a ceramic sleeve 24, a metal ring 26, and a tension element 28 are marked. Sheathed-element glow plug 10 also includes an integrated temperature sensor 30, which extends over essentially the entire length of sheathed-element glow plug 10 along a longitudinal axis 32.

It is believed that the design and function of sheathed-element glow plugs are known and, as such, they are not described in greater detail.

During normal use of sheathed-element glow plug 10, a voltage U is applied to heating pin 14, which causes current I to begin to flow. The size of heating current I depends on the electrical resistance R of heating pin 14, which may be designed so that it functions as a heating element (glow element). In this context, the distribution of electrical resistance R may vary over the length of heating pin 14. For example, in the region of a heating pin tip 34, a higher electrical resistance R may be concentrated, so that a higher voltage U drops lower, and heating inside heating pin tip 34 is greater than in the remaining region of heating pin 14.

Since temperature sensor 30 is integrated into sheathed-element glow plug 10, an instantaneous temperature may be ascertained directly in the region of heating pin tip 34.

Figure 2:
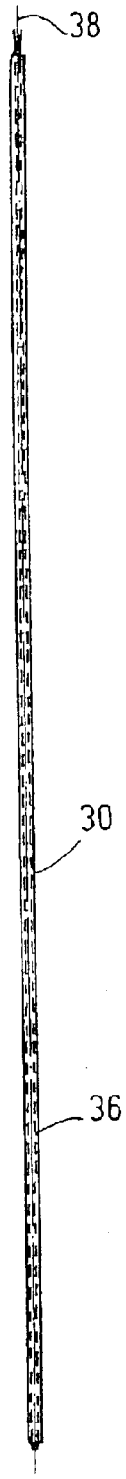
FIG. 2 is a schematic view of a temperature sensor.

Temperature sensor 30 is schematically shown in FIG. 2. Temperature sensor 30 may be made, for example, of a combination of two electrically conductive materials, which produce a voltage proportional to the temperature acting upon the temperature sensor 30. For example, a thermoelement of platinum-platinum/rhodium may form temperature sensor 30. This electrical conductor 36 is placed as a conductor loop inside temperature sensor 30 and may be connected to an evaluation circuit via outer contacts 38. Temperature sensor 30 is made of an electrically nonconductive, temperature-stable ceramic, and includes a double capillary tube (not shown) for accommodating the conductor loops. Temperature sensor 30 is guided through contact stud 18 in an insulating manner. For this purpose, contact stud 18 has a bore hole 40 extending through the longitudinal extension of the sheathed-element glow plug. Since the outer circumference of temperature sensor 30 is made of electrically insulating ceramic, a short-circuit with contact stud 24 may be prevented, or at least made less likely.

Inside heating pin 14, temperature sensor 30 extends directly into heating pin tip 34. Heating pin 14 may be made of the electrically conductive ceramic, which surrounds an insulating core 42, resulting in the formation of the U-shaped conductor loop of the electrically conductive ceramic material of heating pin 14. Temperature sensor 30 is positioned inside insulating core 42, or may itself form insulating core 42, since the outer portion of temperature sensor 30 may have electrically insulating properties. The distance between temperature sensor 30 and the electrically conductive region of heating pin 14 may be, for example, about 0.2 mm.

Figure 3:
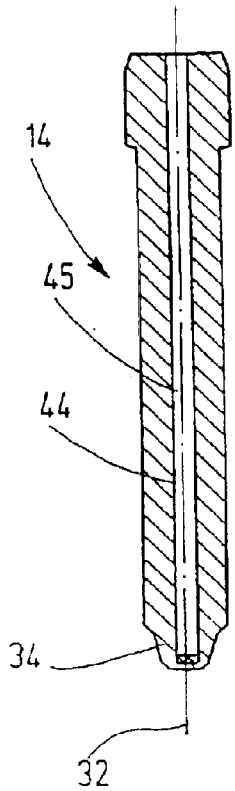
FIG. 3 is a schematic sectional view through a heating pin.

FIG. 3 shows heating pin 14, which has an accommodation 44 running along longitudinal centerline 32, into which temperature sensor 30 may be inserted. Accommodation 44 extends to heating pin tip 34. Accommodation 44 may be formed, for example, by a blind-end bore 45.

Accommodation 44 may be formed, for example, when the ceramic is still a blank. This may avoid chipping (or the like) during the formation of accommodation 44.

Figure 4:
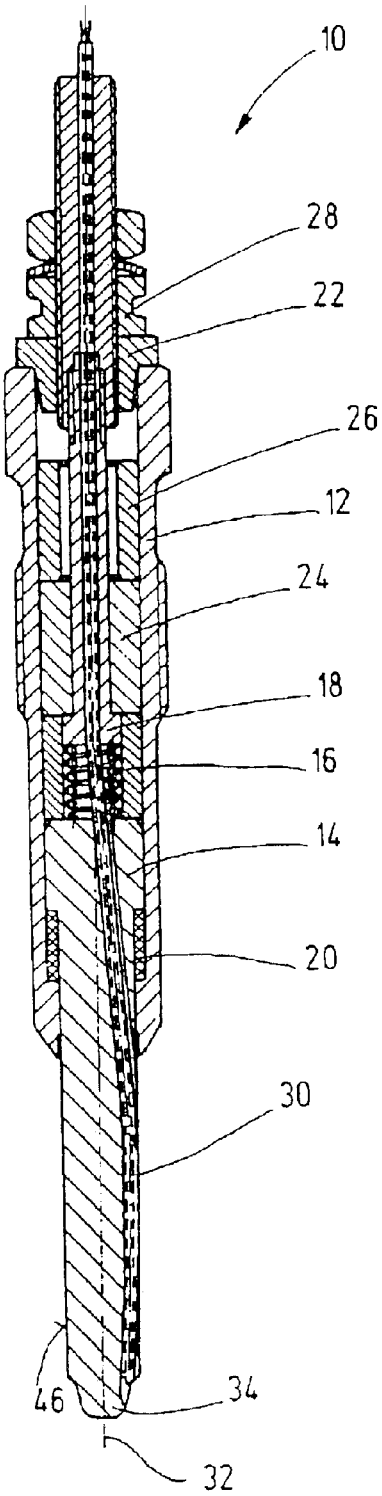
FIG. 4 is a sectional view through a second exemplary sheathed-element glow plug according to the present invention.

FIG. 4 shows a second exemplary sheathed-element glow plug 10 according to the present invention, the same parts as in FIG. 1 being given the same reference numerals. Except for the differences described below, the design and function of the second exemplary embodiment are similar to those of the first exemplary embodiment described above with respect to FIG. 1.

As shown in FIG. 4, temperature sensor 30 is positioned inside heating pin 14 along an orientation deviating from longitudinal centerline 32. The positioning of temperature sensor 30 is selected so that, with increasing approximation to heating pin tip 34, the radial distance from longitudinal centerline 32 increases until temperature sensor 30 intersects circumferential surface 46 of heating pin 14. In this regard, heating pin 14 is shown in FIGS. 5 through 8 in two different exemplary embodiments according to the present invention, respectively.

Figure 5:
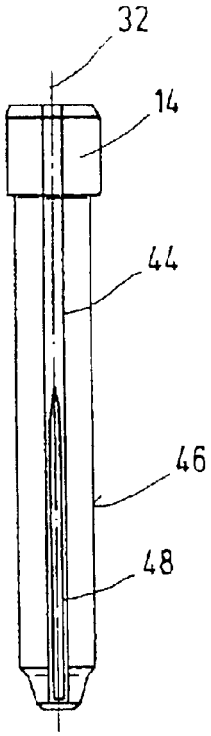
FIGS. 5 & 6 are schematic views of an exemplary heating pin according to the second exemplary embodiment variant of the present invention.
Figure 6:
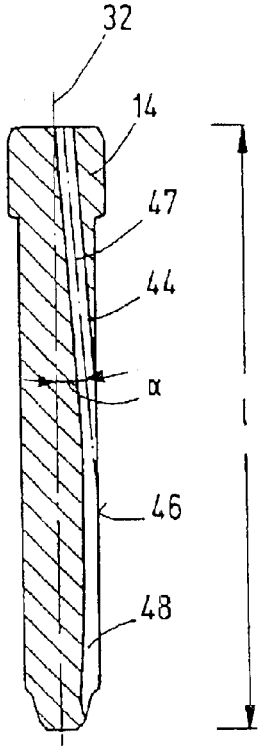

FIG. 5 shows a top view of the heating pin 14 shown in FIG. 4, as seen from the right. FIG. 6 shows a sectional view of FIG. 5 rotated by 90°. Accommodation 44, for the accommodation of temperature sensor 30, is formed by a bore hole 47, which, starting from longitudinal centerline 32, proceeds at an angle $\alpha$ from longitudinal centerline 32. The angle $\alpha$ is selected so that, with respect to overall length 1 of heating pin 14, bore hole 47 opens on circumferential surface 46 at about ½ the length, and changes to an open-edged recess 48. The depth of open-edged recess 48 is adapted to the diameter of temperature sensor 30, so that the latter does not radially protrude above circumferential surface 46 of heating pin 14.

Figure 7:
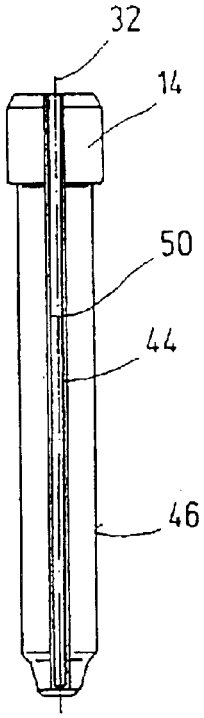
FIGS. 7 & 8 are schematic views of another exemplary heating pin according to the present invention.
Figure 8:
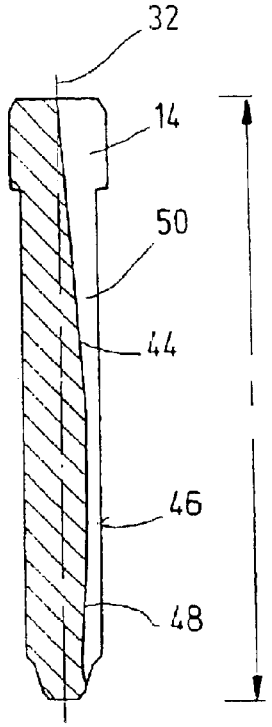

FIGS. 7 and 8 show a further exemplary embodiment according to the present invention, in which accommodation 44 is formed by a radial slit 50, which over length 1 of heating pin 14, declines in depth up to ½ the length and then forms recess 48 open at the edge, as shown in FIG. 6. By forming slit 50, the temperature sensor 30 may be set radially into heating pin 14, whereas, according to the exemplary embodiment described above with respect to FIGS. 5 and 6, the temperature sensor 30 is threaded into bore hole 47, so that it may be positioned into open-edge recess 48.

Both bore hole 47 according to the exemplary embodiment described above with respect to FIGS. 5 and 6, groove 50 according to the exemplary embodiment described above with respect to FIGS. 7 and 8, and open-edge recess 48, which is common to both exemplary embodiments, are positioned in a region of heating pin 14, which is made of an insulating material. Heating pin 14 may be made of a layered construction, with an insulating ceramic embedded in the U-shaped conductor loop made of electrically conductive ceramic. Thus, impairment of the electrically conductive ceramic may be avoided, such as of the cross section of the electrically conductive layer. The temperature sensor 30 may be fastened in bore hole 47 or groove 50, and open-edge recess 48 by glazing using a glass ceramic. In this context, the heat expansion behavior of this glass ceramic, the ceramic material of temperature sensor 30 and the insulating ceramic material of heating pin 14 may be adjusted to one another, so that, when the overall layer composite is heated, an essentially equal heat expansion behavior results.

What is claimed is:

1. A sheathed-element glow plug for starting a self-igniting combustion engine having a combustion chamber containing an ignitable fuel-air mixture, comprising:

a heating pin engaged in the combustion chamber, the heating pin including an electrically conductive ceramic and a blind-end bore accommodation extending along a longitudinal centerline of the heating pin, the heating pin being operable to be heated to an ignition temperature when connected to a voltage source; and an integrated temperature sensor integrated into the accommodation of the heating pin.

2. A sheathed-element glow plug for starting a self-igniting combustion engine having a combustion chamber containing an ignitable fuel-air mixture, comprising:

a heating pin engaged in the combustion chamber, the heating pin including an electrically conductive ceramic and an accommodation extending at an angle to a longitudinal centerline of the heating pin, the heating pin being operable to be heated to an ignition temperature when connected to a voltage source; and an integrated temperature sensor integrated into the accommodation of the heating pin.

3. The glow plug according to claim 2, wherein the accommodation surrounds a bore hole opening at a circumferential surface of the heating pin, and wherein the accommodation forms an open-edge recess at the circumferential surface.

4. The glow plug according to claim 3, wherein the bore hole opens at the circumferential surface of the heating pin at about half a length of the heating pin.

5. The glow plug according to claim 4, wherein the open-edge recess has a depth about equal to a diameter of the temperature sensor.

6. The glow plug according to claim 2, wherein the accommodation surrounds a radial slit, the radial slit forming an open-edge recess.

7. The glow plug according to claim 2, wherein a bore hole opens at a circumferential surface of the heating pin at about half a length of the heating pin.

8. The glow plug according to claim 2, wherein an open-edge recess is formed at a circumferential surface of the heating pin and has a depth equal to a diameter of the temperature sensor.

9. The glow plug according to claim 8, wherein the accommodation surrounds a radial slit, the radial slit forming the open-edge recess.

* * * * *